US005095871A

United States Patent [19]

Mezger

[11] Patent Number: 5,095,871

[45] Date of Patent: Mar. 17, 1992

[54] RECIPROCATING ENGINE WITH TWO CYLINDER BANKS ARRANGED IN A V-SHAPE

[75] Inventor: Hans Mezger, Freiberg, Fed. Rep. of Germany

[73] Assignee: Dr. Ing. h.c.F. Porsche AG, Fed. Rep. of Germany

[21] Appl. No.: 668,602

[22] Filed: Mar. 13, 1991

[30] Foreign Application Priority Data

Oct. 13, 1990 [DE] Fed. Rep. of Germany ..... 4032590

[51] Int. Cl.[5] ..... F02B 77/00

[52] U.S. Cl. ..... 123/198 C; 123/41.47; 123/55 V; 123/196 R

[58] Field of Search ..... 123/41.44, 41.47, 55 V, 123/198 R, 198 C, 195 A, 196 R

[56] References Cited

FOREIGN PATENT DOCUMENTS 3837253 5/1990 Fed. Rep. of Germany .

OTHER PUBLICATIONS

AT271 (1969)0, Mezger, Der Porsche 4, 5-I-Rennsportwagen Typ. 917, pp. 313-320.

Automobile Magazine—ATZ73(1971)5, pp. 179-182.

*Primary Examiner*—Noah P. Kamen

*Attorney, Agent, or Firm*—Evenson, Wands, Edwards, Lenahan, & McKeown

[57] ABSTRACT

In the case of a multi-cylinder reciprocating engine in a V-construction, the crankshaft drives the camshafts and an output shaft to the clutch in a center plane of the engine by means of gear drives. The crankshaft, also by means of gear drives, drives two identically designed pump units comprising a water pump and oil pumps which are mounted on the outside on the crankcase, symmetrically to the center plane of the engine.

13 Claims, 3 Drawing Sheets

RECIPROCATING ENGINE WITH TWO CYLINDER BANKS ARRANGED IN A V-SHAPE

BACKGROUND AND SUMMARY OF THE INVENTION

The invention relates to a reciprocating engine with two cylinder banks arranged in a V-shape with a driving gear train originating from an engine crankshaft and leading to camshafts and to an engine clutch disposed in a center plane of the engine.

This type of a reciprocating engine is known from the DE-Z Special Printing *ATZ, Automobiltechnische Zeitschrift*, 71st Year, No. 9/12/1969 and 73rd Year, No. 5/1971. An output shaft to the clutch driven by the crankshaft—viewed in the vertical direction of the vehicle—extends below the crankshaft and in parallel to it. It is driven by the crankshaft by way of a gearbox which is arranged in a center plane between the two crankshaft ends. The output shaft, also by way of a gearbox, drives the oil pumps arranged in the crankcase of the engine.

It is an object of the invention to arrange the pumps required for the supply of the engine in such a manner that they are easily accessible for repair work, that, as a result of their arrangement, the center of gravity of the engine is as low as possible, and the engine as a whole has a symmetrical construction.

This object is achieved according to preferred embodiments of the invention by providing an engine wherein pump units comprising a water pump and at least one oil pump are arranged outside an engine crankcase on both longitudinal sides of the crankcase above its bottom part. If the pumps are mounted on the outside on the engine power section, they will be optimally accessible for mounting and repair work. Since they are arranged closely above the bottom part of the crankcase, they contribute desirably to lowering the center of gravity of the engine. A symmetrical construction of the engine can be achieved according to preferred embodiments with identically designed pump units consisting of the water pump and the oil pump mounted on both longitudinal sides of the crankcase.

Other objects, advantages and novel features of the present invention will become apparent from the following detailed description of the invention when considered in conjunction with the accompanying drawings.

DETAILED DESCRIPTION OF THE DRAWINGS

Figure 1:
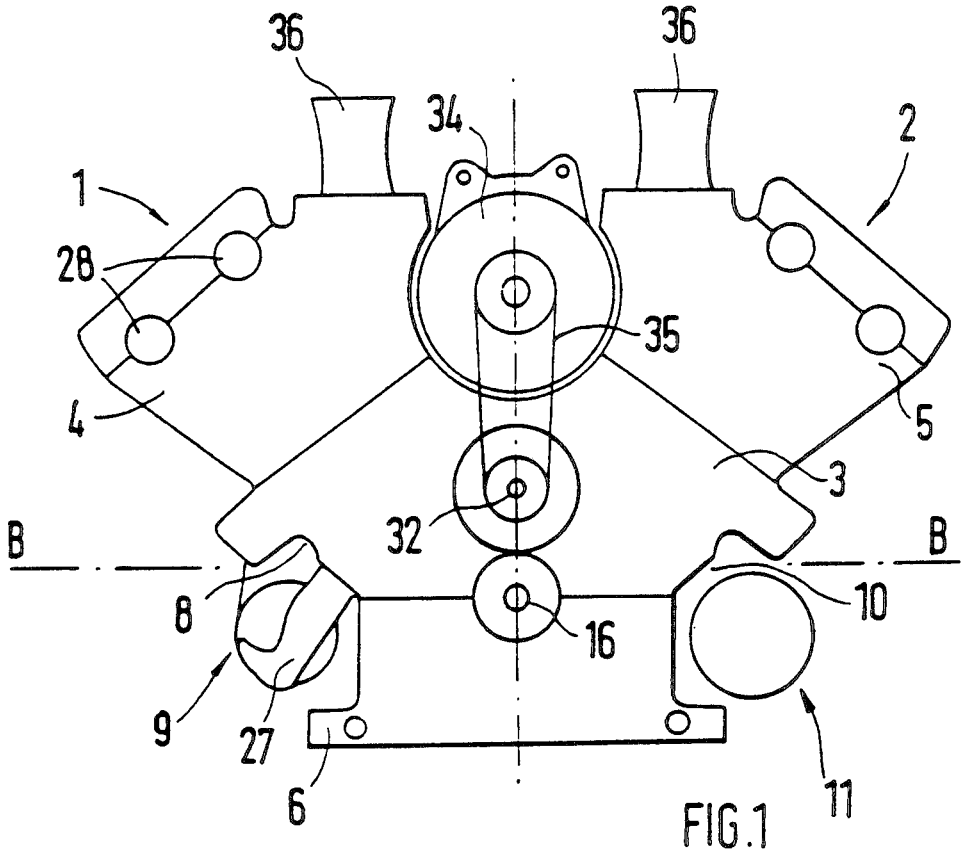
FIG. 1 is a schematic front view of a reciprocating engine constructed according to a preferred embodiment of the invention.
Figure 2:
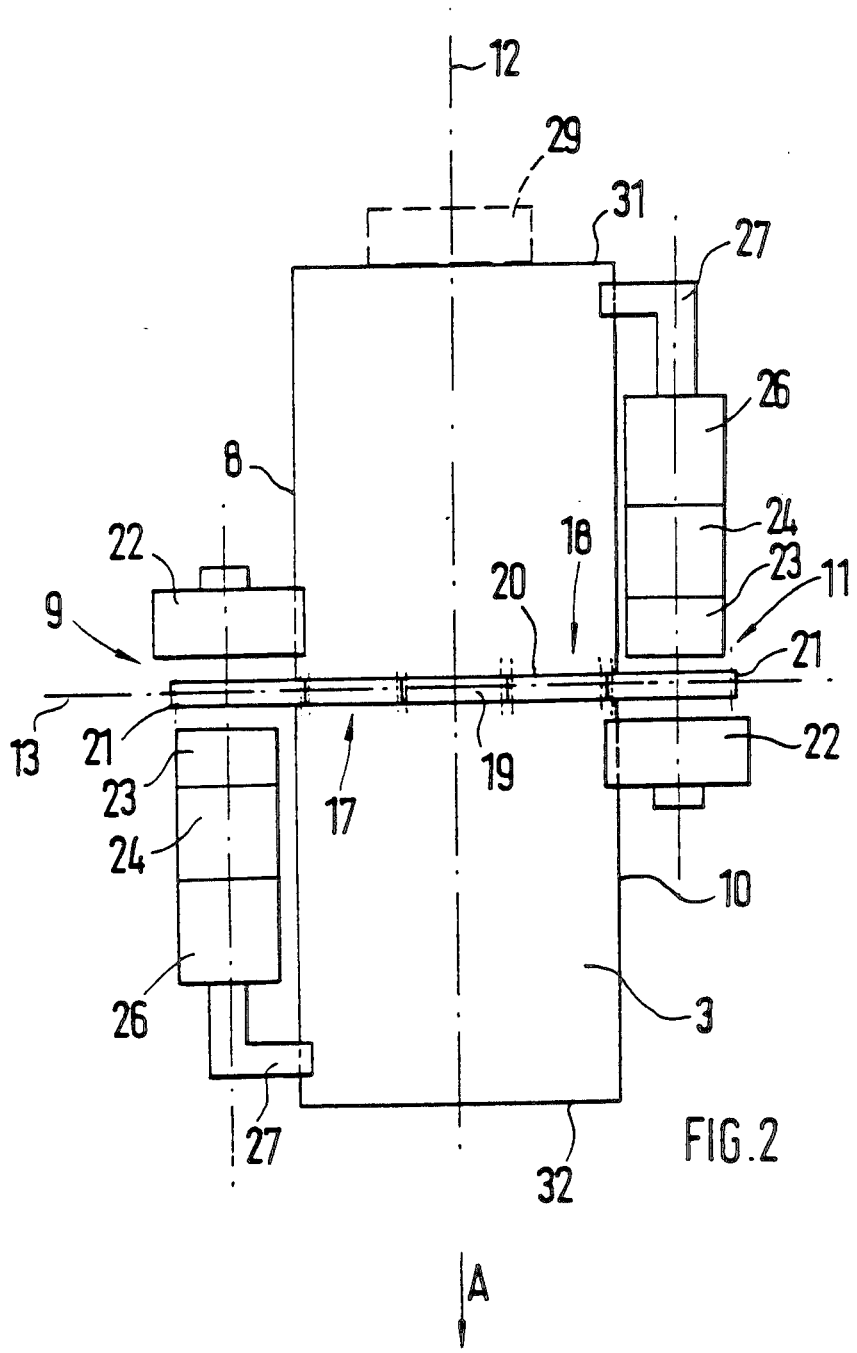
FIG. 2 is a top schematic view of the reciprocating engine from the Plane B—B of FIG. 1.
Figure 3:
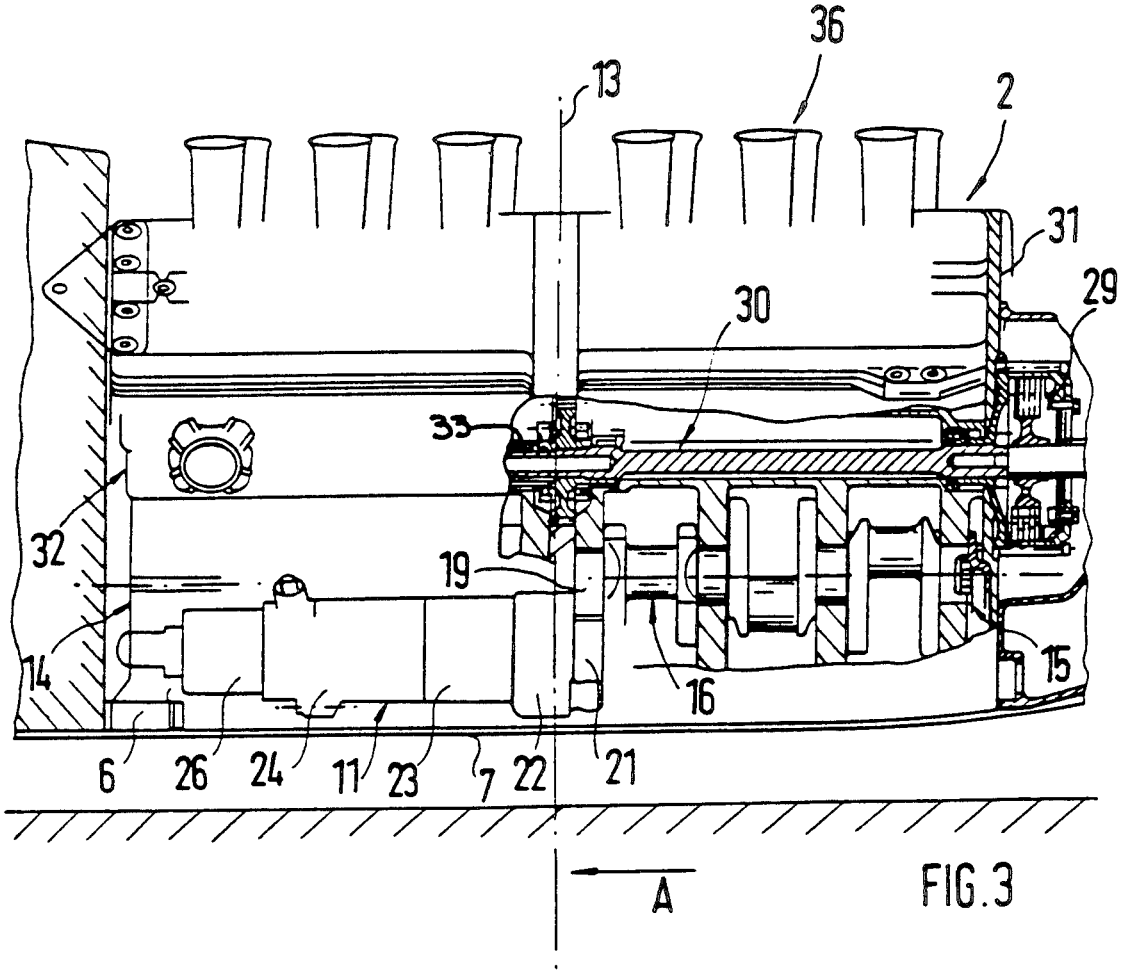
FIG. 3 is a lateral schematic view and a partial longitudinal sectional view of the reciprocating engine of FIGS. 1 and 2.

A 12 cylinder reciprocating engine comprises two cylinder banks 1 and 2 having 6 cylinders respectively and arranged in a V-shape with respect to one another. A power section of the reciprocating engine comprises a lower crankcase 3 and two head casings 4 and 5 which enclose the valve gears constituting part of the driving gear train of both cylinder banks and are screwed to its top side. By means of its bottom part base plate 6, the crankcase 3 is screwed or bolted to the floor 7 of the vehicle frame.

For supplying the engine with liquid, a pump unit 9 is screwed on the outside to the crankcase 3, closely above its base plate 6, on the right longitudinal side 8, viewed in the driving direction A, and a pump unit II is screwed on on the left longitudinal side 10. The two pump units 9 and 11 have the same design. They are arranged symmetrically with respect to the longitudinal center axis 12 of the engine and to the center plane 13 disposed transversely with respect to it and pointing in the vertical direction of the engine. The center plane 13 is situated precisely in the center between the forward end 14 and the rearward end 15 of the crankshaft 16. A gear drive 17 for the left pump unit, and a gear 18 for the right pump unit are disposed in the center plane 13. The gear drives 17 and 18 each comprise a crankshaft timing gear 19, an intermediate timing gear 20 and a pump shaft gear 21.

Both pump units 9 and 11 comprise a water pump 22, an oil suction pump 23 and an oil pressure pump 24 which, in this sequence, are arranged next to one another, are coaxial with respect to one another, and are driven by the pump shaft gear 21. The housings of the pumps 22, 23, 24 and of the oil filter 26 are screwed together. The water pump 22 of the right pump unit 9 is disposed behind the center plane 13. For the mounting on the left longitudinal side 10 of the crankcase 3, the same pump unit is rotated by 180° so that the water pump 22 is situated directly in front of the center plane 13. The pump shaft gear 21 is disposed between the water pump 22 and the oil suction pump 23 which takes in lubricating oil from the crankcase 3. By means of the oil pressure pump 24 of the right pump unit 9, by way of a connection elbow 27, the engine half situated in front of the center plane 13 is supplied with lubricating oil; by means of the oil pressure pump 24 of the left-hand pump unit 11, the rear engine half is supplied with lubricating oil.

It is therefore not necessary to extend the oil supply ducts for the crankshaft bearings and the bearings of the four camshafts 28 by way of the center plane 13 which is crowded with gears. The water pump 11 of the left pump unit 11 supplies the whole left cylinder bank 2 with cooling water; the right water pump 22 supplies the right cylinder bank 1 with cooling water.

In addition to the gear sets for the pump drive, a gear drive from the crankshaft 16 to a drive shaft 30 which drives the clutch 29, and the not shown driving gears for the camshafts 28 are also arranged in the center plane 13. The output drive shaft 30, which extends above the crankshaft 16 and in parallel to it, leads to the clutch 29 situated on the rearward end face 31 of the engine. Further details of the pump unit arrangements are included by reference to my co-pending, commonly assigned application Ser. No. 668,930, filed on even date herewith, and based on German Patent Application P 40 32 591.1, filed Oct. 19, 1990 in Germany.

Another gear drive leads from the crankshaft 16 to an intermediate shaft 33 by which a generator 34, which is arranged on the forward end face 32 of the engine, is driven by means of a front-side belt drive 35. The generator 34 is situated in the V-center between the two cylinder banks 1 and 2. This space can be utilized for the generators 34 because, as a result of the installation of separate suction pipe tubes 36 for each cylinder, a common air intake system, which is normally arranged in the V-center, is no longer necessary. Further details of the camshaft drive arrangements are included by reference to my co-pending commonly assigned application Ser. No. 669,011, filed on even date herewith, and based on German Patent Application P 40 32 593.8, filed Oct. 13, 1990 in Germany.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A reciprocating engine for a motor vehicle with two cylinder banks arranged in a V-shape, a driving gear train operatively arranged between camshafts and an engine clutch which is located substantially at the center of the engine, and a water pump and at least one oil pump arranged outside an engine crankcase on both longitudinal sides and above the bottom part of the crankcase, wherein the water pump, viewed in the driving section, on one longitudinal side of the crankcase is arranged directly in front of a center plane of the engine, and the water pump on the other longitudinal side of the crankcase is arranged behind the center plane of the engine and directly adjacent thereto.

2. A reciprocating engine according to claim 1, wherein the water pump, the oil suction pump, and the oil pressure pump are arranged coaxially with respect to one another and are jointly driven by a pump shaft gear.

3. A reciprocating engine according to claim 2, wherein the oil suction pump and the oil pressure pump are enclosed by a common housing.

4. A reciprocating engine according to claim 1, wherein one water pump supplies the cylinder bank on the one longitudinal side of the engine, and the other water pump supplies the cylinder bank on the other longitudinal side of the engine.

5. A reciprocating engine according to claim 1, wherein the at least one oil pump are an oil suction pump and an oil pressure pump.

6. A reciprocating engine according to claim 5, wherein the oil suction pump and the oil pressure pump constitute a left pump unit on the one longitudinal side of the engine and are, in this sequence, arranged behind the center plane, of the engine and the oil suction pump and the oil pressure pump constitute a right pump unit on the other longitudinal side of the engine and are arranged in front of the center plane of the engine.

7. A reciprocating engine according to claim 6, wherein the water pump of the left pump unit supplies the cylinder bank on the one longitudinal side of the engine, and the water pump of the right pump unit supplies the cylinder bank on the other longitudinal side of the engine.

8. A reciprocating engine according to claim 7, wherein the oil pressure pump of the left pump unit supplies lubricating oil to the engine half situated behind the center plane of the engine, and the oil pressure pump of the right pump engine supplies lubricating oil to the engine half situated in front of the center plane of the engine.

9. A reciprocating engine according to claim 6, wherein the oil pressure pump of the left pump unit supplies lubricating oil to the engine half situated behind the center plane of the engine, and the oil pressure pump of the right pump engine supplies lubricating oil to the engine half situated in front of the center plane of the engine.

10. A reciprocating engine according to claim 5, wherein the one water pump supplies the cylinder bank on the one longitudinal side of the engine, and the other water pump supplies the cylinder bank on the other longitudinal side of the engine.

11. A reciprocating engine according to claim 5, wherein the oil pressure pump of the pump unit on the one longitudinal side of the vehicle supplies lubricating oil to the engine half situated behind the center plane of the engine, and the oil pressure pump of the right pump unit on the other longitudinal side of the engine supplies lubricating oil to the engine half situated in front of the center plane of the engine.

12. A reciprocating engine according to claim 11, wherein the water pump on the one longitudinal side of the engine supplies the cylinder bank on the one longitudinal side of the engine, and the water pump on the other side of longitudinal side of the engine supplies the cylinder bank on the other longitudinal side of the engine.

13. A reciprocating engine according to claim 1, wherein twelve cylinders are provided.

* * * * *